US005102111A

United States Patent [19]

Reponty

[11] Patent Number: 5,102,111

[45] Date of Patent: Apr. 7, 1992

[54] FOLDER FOR A PRINTING MACHINE

[75] Inventor: Andrû Reponty, Gouvieux, France

[73] Assignee: Heidelberger Druckmaschinen AG, Heidelberg, Fed. Rep. of Germany

[21] Appl. No.: 620,837

[22] Filed: Nov. 28, 1990

[30] Foreign Application Priority Data

Nov. 28, 1989 [FR] France ..... 89 15615

[51] Int. Cl.[5] ..... B41F 13/64

[52] U.S. Cl. ..... 270/12; 271/202; 270/51

[58] Field of Search ..... 270/32, 51, 52, 54, 270/55, 57, 58, 12; 271/280, 281, 202; 198/461, 462

[56] References Cited

U.S. PATENT DOCUMENTS

| | | | |
|---|---|---|---|
| 3,994,221 | 11/1976 | Littleton . | |
| 4,040,617 | 8/1977 | Walkington | 271/202 |
| 4,346,881 | 8/1982 | Frye | 271/202 |
| 4,720,091 | 1/1988 | Kobler | 270/57 |
| 4,905,981 | 3/1990 | Reist | 271/202 |
| 4,993,702 | 2/1991 | Jackson | 271/202 |

FOREIGN PATENT DOCUMENTS

| | | | |
|---|---|---|---|
| 0189897 | 8/1986 | European Pat. Off. | 271/202 |
| 2114865 | 10/1972 | Fed. Rep. of Germany . | |
| 2141340 | 2/1973 | Fed. Rep. of Germany . | |
| 2022556 | 12/1979 | United Kingdom | 271/202 |
| 2059392 | 4/1981 | United Kingdom | 271/202 |

*Primary Examiner*—Edward K. Look
*Assistant Examiner*—Therese M. Newholm
*Attorney, Agent, or Firm*—Herbert L. Lerner; Laurence A. Greenberg

[57] ABSTRACT

A folder for a printing machine includes a first conveyor for conveying signatures at a given speed, and a second conveyor for conveying signatures at a lower speed than the given speed, the second conveyor being located at a downstream end of the first conveyor in a conveying direction of the first conveyor for receiving the signatures directly from the first conveyor, and decelerating means including at least one gripper element engageable with the signatures received on the second conveyor for braking the given speed of the received signatures to the lower speed.

14 Claims, 3 Drawing Sheets

FOLDER FOR A PRINTING MACHINE

The invention relates to a folder or folding machine or apparatus for a printing machine.

Heretofore known folders or folding machines include a high-speed first conveyor carrying a succession of folded copies or signatures spaced at a distance from one another greater than their length (so that they do not overlap) and a low-speed second conveyor located at a downstream end of the first conveyor and carrying a second succession of signatures at a distance from one another which is smaller than the length thereof (so that the signatures or printed copies overlap like shingles or fish scales).

An outlet or exit from the second conveyor corresponds also to the outlet or exit of the folder, downstream from which there is usually provided a "counter-stacker" device which produces tied bundles of the signatures.

The change from the high speed to the low speed between the first and the second conveyors is generally accomplished by means of a device known as a fan which includes parallel wheels mounted on a common shaft and having a profile defining curved pockets into which the first conveyor slides the copies. The shaft carrying these wheels is rotated at a slow speed so that each arriving signature falls into an empty pocket next to the pocket containing the just previously arrived signature. The second conveyor is below the fan which serves as a decelerating or slowing device and the signatures fall onto it at the aforementioned spaced distance wherein succeeding signatures are overlapped like shingles or fish scales.

This type of slowing device is satisfactory for stiff signatures, printed on heavy paper or formed of a large number of pages. For lighter papers or signatures with fewer pages, the signature is slowed by the leading edge thereof and tends to deform and crumple in the pocket due to the inertia thereof. As a result, the position of the signature is not accurately defined, the signature bounces around inside the pocket, and the second succession of signatures is irregular. This phenomenon is accentuated if the width of the paper is less than the total width of the folder, because, in such a case, the signature touches only some of the support strips in the slowing device. The resulting irregularities are especially troublesome in that they prevent correct operation of the counter-stacker, leading to jamming, tearing and creasing.

More particularly, from the European Published Patent Application 0 189 897 A2, a device for increasing the conveying speed of paper products has become known heretofore, wherein five rollers rotatable about a common axis and having a stellar arrangement are disposed above a first endless conveyor belt. A partial length or stretch of another endless belt running over a plurality of deflecting rollers is guided over two of the rollers of the stellar arrangement in parallel with the first endless belt. The rotational speed of the rollers of the stellar arrangement differs from the rotational speed of the two endless belts and effects an acceleration of the paper products.

A disadvantage of this heretofore known device is that three separate drives or one drive with interconnected transmission or reduction gearing are required, with the result that synchronization of the endless belts is quite expensive and noneconomical.

Another undesirable characteristic of the aforementioned heretofore known device is that the paper products are subjected to great mechanical stress by the rollers of the stellar arrangement, because those rollers cause the first endless belt, in spite of the resilient or springy mounting thereof, to bulge outwardly in a downward direction.

It is accordingly an object of the invention to provide a folder for a printing machine, which overcomes the hereinafore-mentioned disadvantages of heretofore-known apparatus of this general type.

With the foregoing and other objects in view, there is provided, in accordance with the invention, a folder for a printing machine comprising a first conveyor for conveying signatures at a given speed, and a second conveyor for conveying signatures at a lower speed than the given speed, the second conveyor being located at a downstream end of the first conveyor in a conveying direction of the first conveyor for receiving the signatures directly from the first conveyor, and decelerating means comprising at least one gripper element engageable with the signatures received on the second conveyor for braking the given speed of the received signatures to the lower speed.

In this regard, it is advantageous that the signatures are not gripped at the leading edge thereof for the purpose of decelerating them, but rather, experience an appropriate alignment in a shingle stream by one or more gripper elements. A subsequent further processing of the signatures is thereby considerably simplified. The use of two conveyors permits precise guidance of the signatures at different conveying speeds.

In accordance with another feature of the invention, the folder further comprises means for disposing the signatures in succession on the first conveyor at a spaced distance between respective leading edges thereof which is greater than the length of one of the signatures, and means for disposing the signatures received on the second conveyor in an overlapping or shingle stream. The deceleration on a shorter delay path in the folder is, accordingly, of advantage.

In accordance with a further feature of the invention, the decelerating means have a main shaft and a hollow cylinder having cylindrical end faces carried by the main shaft, the at least one gripper element being mounted on at least one additional shaft disposed in the hollow cylinder and having a tangential speed corresponding to the lower speed. An advantage of this feature is that no relative speed exists between the endless belt and the gripper element and, accordingly, the braking action at the upper side and the underside occurs simultaneously. As the decelerating means rotate, a periodic braking by the gripper elements of the speed of the endless belt of the second conveyor is realized.

In accordance with alternate feature of the invention, the gripper element is either fixed or rotatably mounted in the decelerating means.

In accordance with an added feature of the invention, the gripper element is rotatable in a direction opposite to a direction of rotation of the decelerating means. The rotation of the gripper element thus advantageously permits an effective delay of the signatures being received on the second conveyor. Due to the rotation of the gripper element in an opposite direction to the conveying direction of the lower endless belt, a uniform shingled distribution of the signatures is afforded even at high feeding speeds.

In accordance with an additional feature of the invention, the folder has opposite frame walls wherein the main shaft is journaled, respective pulleys fastened to the frame walls at respective ends of the main shaft, at least another gripper element mounted on at least another additional shaft in the hollow cylinder, a respective pulley mounted at one of the ends of the additional shafts, and respective bets disposed and rotatable on respective pairs of one of the pulleys fastened to the frame walls and one of the pulleys mounted at one of the ends of the additional shafts. Advantageously, by this feature, a reliable drive for the gripper element is attained in a compact, space-saving construction.

In accordance with yet another feature of the invention, the first and the second conveyors, respectively comprise a lower endless belt for receiving thereon a respective succession of the signatures to be conveyed, respective driven cylinders cooperatively coupled with the lower endless belts, respectively, for maintaining a ratio between the lower speed and the given speed so that the decelerating means grip a respective signature at an appropriate moment, the driven cylinders being coupled with a drive of the printing press for matching the speeds at which the respective successions of signatures are conveyed. This ensures a precise, synchronous interplay or combination of the individual conveyors and the decelerating means, which requires no readjustment and remains constant over the entire period of operation.

In accordance with yet a further feature of the invention, the folder includes adjusting means for controlling the height at which the rotational axis of a cylinder cooperatively coupled with the lower endless belt cf the second conveyor is disposed and for enabling adjustment of the gripper action of the decelerating means. This permits a relatively simple adjustment or matching of the deceleration means to different types of paper as well as to different types of folds, the spacing or distance between the leading edges of successive signatures in a shingled stream being adjustable. In accordance with yet an added feature of the invention, the first and the second conveyors, respectively, include an upper endless belt similar to the lower belt for ensuring successive disposition of the signatures, the driven cylinders of the first conveyor being mutually cooperative so that the upper endless belt and the lower endless belt of the first conveyor travel at the given speed, and the driven cylinders of the second conveyor being mutually cooperative so that the upper endless belt and the lower endless belt of the second conveyor travel at the lower speed. An advantage thereof is the guidance of the signatures on the upper side and the underside thereof at the same speeds so that slippage of the signatures is avoided and a uniform distribution thereof is achieved.

In accordance with yet an additional feature of the invention, the lower and upper belts of the first conveyor are rotatingly mounted around driven cylinders having respective axes of rotation disposed in a transversely inclined plane. This assists in the transition of the signatures exiting from the first conveyor onto the second conveyor and, therefore, also permits higher production speeds.

In accordance with another feature of the invention, an upstream end of the upper belt of the second conveyor intersects with a downstream end of the upper belt of the first conveyor for guiding the signatures received by the second conveyor from the first conveyor at a transition location therebetween. An advantage of this feature is the guidance by entrained belts at the transition or transfer location of the signatures, so that no relative movements occur between the upper side and the underside of the signatures and between the endless conveyor belts.

In accordance with a further feature of the invention, the upper endless belts, respectively, are each formed of a row of endless sub-belts, and there are included at the downstream end of the upper belt of the first conveyor, a shaft carrying a plurality of rollers, respective rollers of mutually adjacent pairs thereof being rotatable independently of one another and cooperating respectively with a respective sub-belt of the upper endless belt of the first conveyor and a respective sub-belt of the upper endless belt of the second conveyor. Thus, in a space-saving construction, an upper endless belt guidance is attained. The independence of the rotation of the individual rollers from one another permits uniform tensioning of the sub-belts.

In accordance with a concomitant feature of the invention, the decelerating means comprise a rotatable hollow cylinder carrying the at least one gripper element, and the sub-belts of the upper endless belt of the second conveyor connect an exit of the first conveyor with an upstream entrance to the lower belt of the second conveyor, the last-mentioned sub-belts being rotatably mounted on and between an outer cylindrical surface of the hollow cylinder and respective rollers carried by the shaft at the downstream end of the upper belt of the first conveyor.

Other features which are considered as characteristic for the invention are set forth in the appended claims.

Although the invention is illustrated and described herein as embodied in a folder for a printing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawing, in which.

The illustrated folder is constructed so that it can be located at the conventional exit from a rotary printing press in order to cut and fold a continuous web or strip of printed paper leaving the press.

In a conventional manner, the web initially passes over a non-illustrated triangular device or former by which it is folded in half longitudinally.

Figure 1:
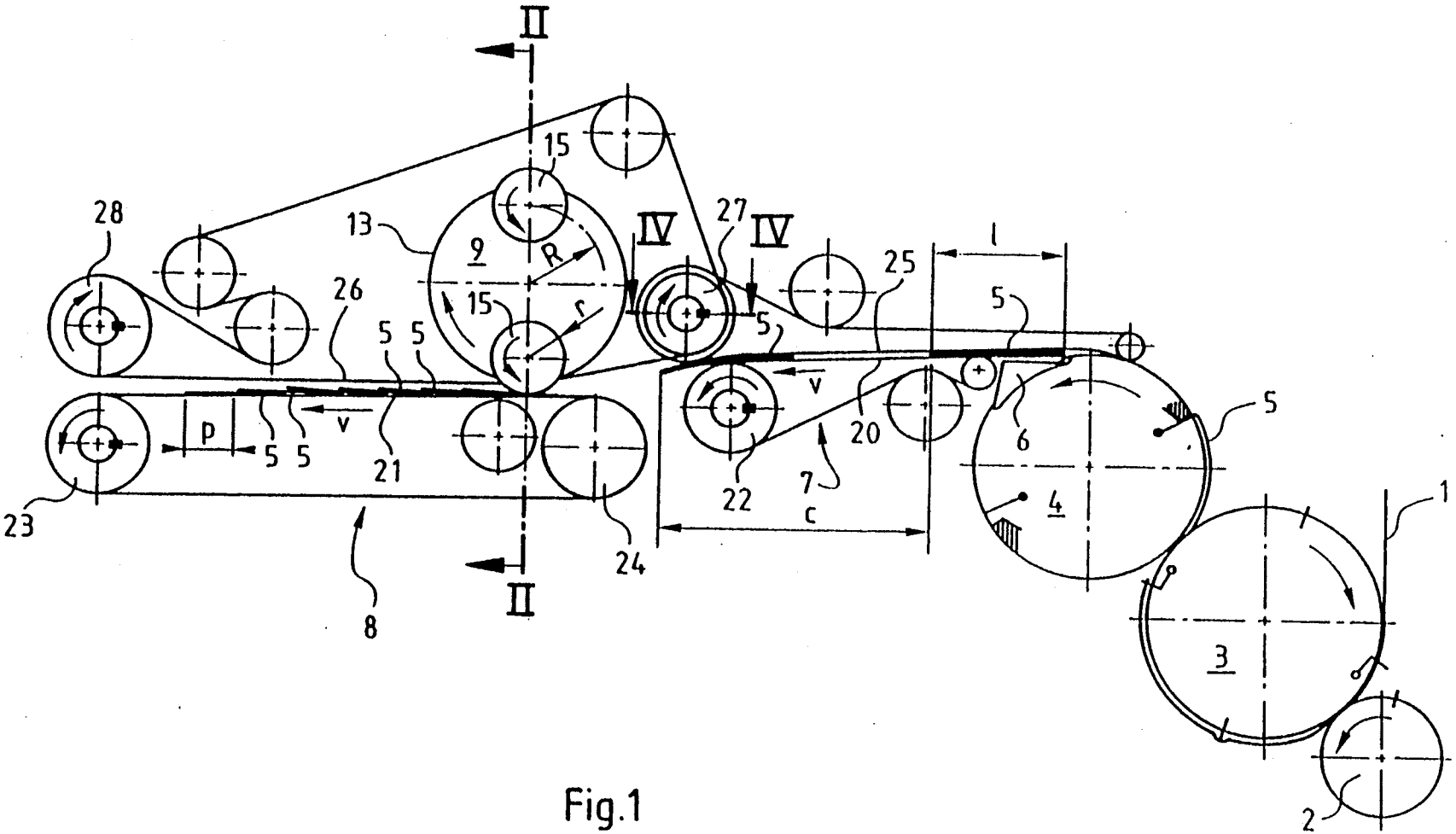
FIG. 1 is a diagrammatic longitudinal sectional view of a folder or folding machine or apparatus in accordance with the invention.

Referring now to the figures of the drawing in detail and first, particularly, to FIG. 1 thereof, there is shown therein the folded web 1 which then passes between a cutter roller 2 and a needle or transfer cylinder 3, which together cut it successively into folded sheets; the latter are folded with a first crossfold halfway between the cut edges thereof as the folded sheets pass between the transfer cylinder 3 and a folding jaw cylinder 4, thereby becoming so-called signatures 5 which are stripped from the cylinder 4 by strippers 6.

Downstream from the folding jaw cylinder 4, in the travel direction of the signatures, is a first conveyor 7 onto which the signatures 5 stripped from the folding jaw cylinder 4 by the strippers 6 are deposited. The conveyor 7 carries the signatures 5 at a linear speed V, which is the same speed as that of the printing press. On the conveyor 7, the signatures 5 are disposed at a distance C between respective leading edges of the successive signatures 5 which is equal to the circumference of the non-illustrated impression cylinder of the printing press, the length 1 of the signatures 5 being equal to half the distance C because the crossfold is formed in the middle of the severed web section by a folding or tucking blade between the needle cylinder 3 and the folding jaw cylinder 4.

On a second conveyor 8, at the downstream end of the conveyor 7, the signatures 5 are disposed at a distance p between respective leading edges of the successive signatures 5, which is less than the length 1 thereof, so that the successive signatures 5 overlap in the manner of shingles or fishscales. The signatures 5 on the second conveyor 8 travel at a speed v which is less than the aforementioned speed V thereof when they are on the first conveyor 5, of condition that the number of signatures 5 per unit time remains the same. The value of v is given by the equation:

$$v = V \cdot p / C$$

Both of the conveyors 7 and 8 are so disposed with respect to one another that the signatures 5 leaving the conveyor 7 at the speed V land directly on the conveyor 8 and, at the appropriate instants of time, are braked by a decelerating or retarding device 9 in the form of a drum or cylinder.

Each oncoming signature 5 leaving the conveyor 2 at a travel speed substantially equal to V, slides onto a preceding signature 5 located at the entry end of the conveyor 8 and moving at the speed v. When the newly deposited signature 5 has slid or slipped sufficiently on the respective underlying signature 5 for the distance between the respective leading edges thereof, i.e., the pitch p of the signatures 5, to be achieved, the newly arrived signature 5 is pressed by gripper elements 15, which have a tangential speed equal to the speed v, against the conveyor 8 so that the newly arrived signature 5 assumes the speed v.

The conveyors 7 and 8 are each formed with a respective lower endless belt 20 and 21 which, in this embodiment of the invention, are each made up of a plurality of narrow sub-belts although, in an alternative embodiment, these could be replaced by a single endless belt.

The belts 20 and 21 revolve around cylinders and rollers, including a driven cylinder 22 which is the drive cylinder for the belt 20 and a driven cylinder 23 which is the drive cylinder for the belt 21, as well as nondriven cylinders and rollers serving as idler rollers for guiding and tensioning the belt.

The position of a cylinder 24 of the second conveyor 8 is adjustable so that the intensity of the braking force applied by the decelerating device 9 can be adjusted by engaging or disengaging the cylinder 24.

Each of the conveyors 7 and 8 further includes a respective upper endless belt 25,26 similar to the respective lower endless belt 20,21 with which it cooperates to grip the succession of signatures 5 therebetween, the belt 25 having a drive roller 27, and the belt 26 having a drive roller 28.

Figure 5:
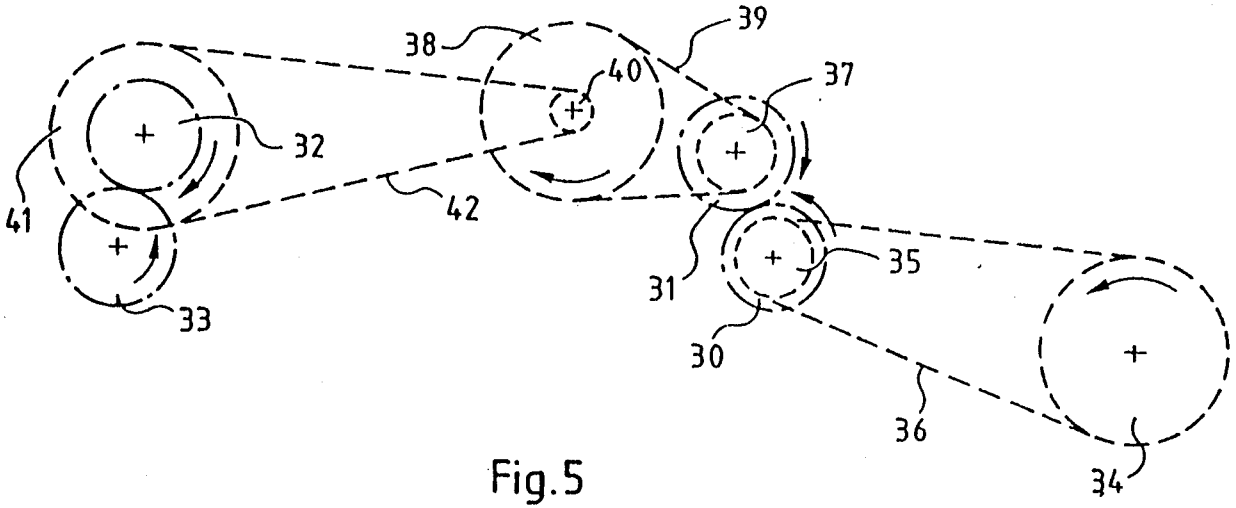
FIG. 5 is a highly diagrammatic longitudinal elevational view of a kinematic or drive system of the folder located outside the support frame therefor.
Figure 6:
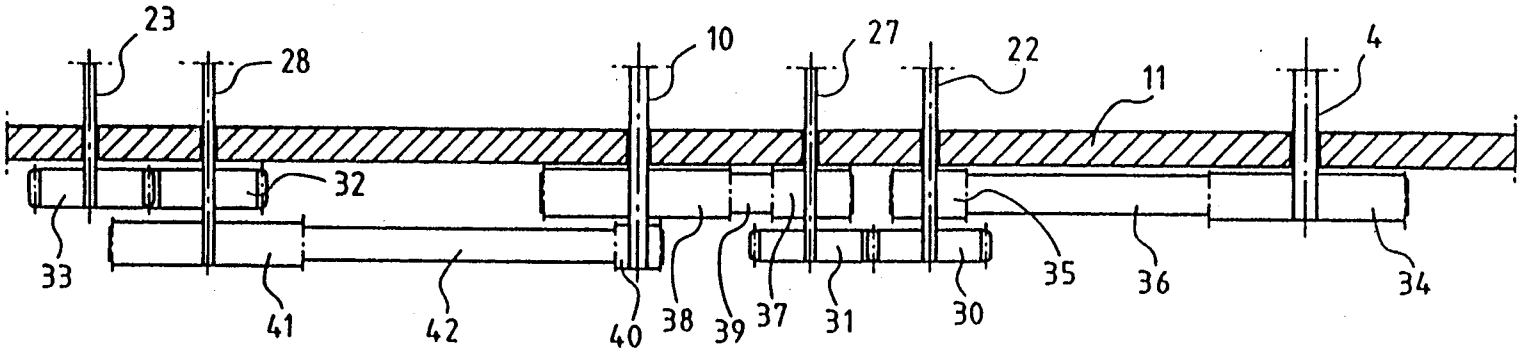
FIG. 6 is a fragmentary longitudinal sectional view of FIG. 5 taken along an imaginary line passing through the rotational axes shown therein.

The respective drive cylinders 22, 27 and 23, 28 of the upper and the lower belts of each of the two conveyors 7 and 8 are coupled kinematically so that the upper and lower belts travel at the same speed. As seen in FIGS. 5 and 6, which are described hereinafter in greater detail, the cylinders 22 and 27 cooperate through similar meshing gears 30 and 31, and the cylinders 28 and 23 cooperate through similar meshing gears 32 and 33.

Figure 2:
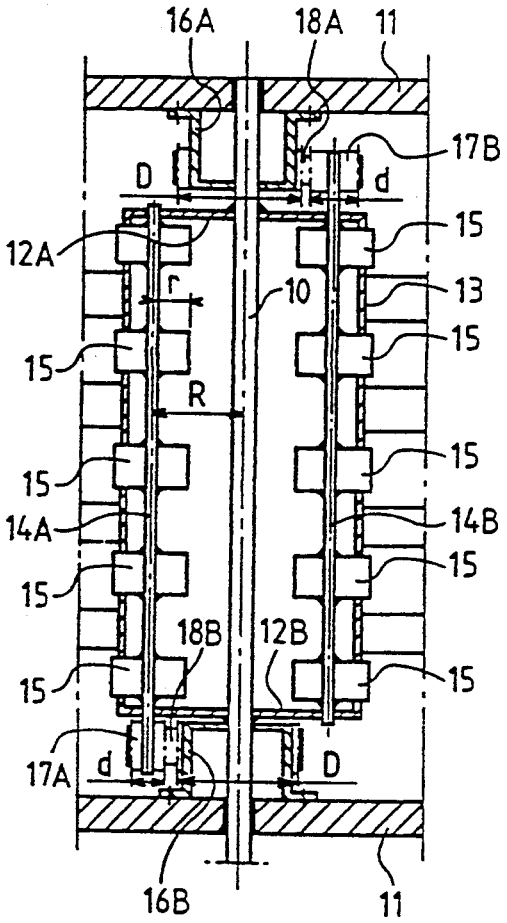
FIG. 2 is a fragmentary cross-sectional view of FIG. 1 taken along the line II—II and rotated through 90 degrees, showing a drum of a decelerating device forming part of the folder.

As viewed in FIG. 2, the deceleration or retarding device 9 has a central shaft 10 mounted rotatably on a frame 11 of the folder, two circular flanges 12A and 12B welded to the shaft 10 and a hollow cylinder or tube 13 welded to the flanges 12A and 12B and coaxial with the shaft 10. Each of two diametrically opposite shafts 14A and 14B spaced a distance R from the shaft 10 (as measured between the axes thereof) carries a plurality of gripper elements in the form of rollers 15 having a radius r and being welded to the respective shaft 14A,14B. The peripheral surfaces of the gripper elements 15 are provided with elastomeric tires or an elastomeric coating. Openings are formed in the hollow cylinder 13 to permit the rollers 15 to protrude therethrough, the sum of the radii R+r being greater than the radius of the cylinder 13.

At each end face of the cylindrical decelerating device 9, a respective fixed pulley 16A and 16B having a diameter D is mounted on the frame 11 coaxially with the cylinder 9. Each of the shafts 14A and 14B is provided with a respective pulley 17A and 17B having a diameter d, the pulleys 16A and 17B having an endless belt 18A revolving around them, and the pulleys 16B and 17A having a belt 18B revolving around them so as, thereby, to drive the shafts 14A and 14B.

The cylindrical decelerating device 9 rotates at such a speed that the tangential component of the speed of the cylinder 13 thereof is greater than the speed v, and the rollers or gripper elements 15 turn in a direction opposite to the direction of rotation of the decelerating device 9 at such a speed that the difference therebetween is equalized or balanced, in other words so that the gripper elements or rollers 15 have a tangential speed equal to the speed v.

The rotational speed of the cylindrical decelerating device 9 (expressed in revolutions per unit time) is equal to the speed of the stream of signatures (expressed as a number of copies per unit time) divided by the number k of the gripper elements which are provided. In this instance, k=2, which is because when a new signature has been substituted for a previous signature, a gripper element must be substituted for the gripper element preceding it.

Figure 3:
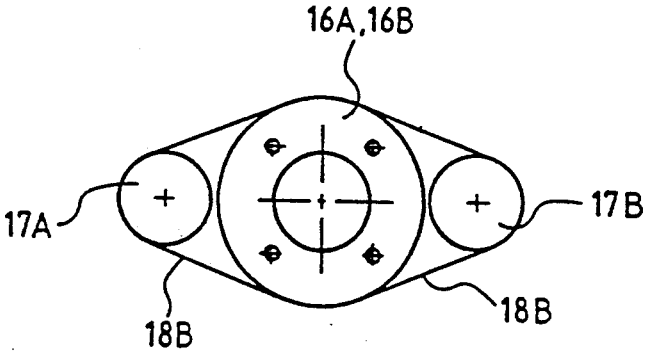
FIG. 3 is an enlarged diagrammatic bottom end view of FIG. 2, with the drum and the rollers of the stellar arrangement omitted so as to show more clearly the drive for rotating those rollers.

FIG. 3 diagrammatically shows the cooperation of the belts 16A, 16B, 17A and 17B; when the decelerating device 9 rotates in the direction represented by the associated arrow in FIG. 1, the pulleys 17A and 17B and, therefore, the rollers or gripping elements 15 turn in the opposite direction, as also shown by the associated arrows in FIG. 1.

Thus, the drive for the gripper elements or rollers 15 is illustrated. The ratio of the diameters D/d of the belt pulleys 16A,16B and 17A,17B is given by the equation:

$$D/d = R/r - pk/2\pi r.$$

In an alternative embodiment in which the gripper element is simply a part of increased thickness fixed to the peripheral surface or casing of the cylinder, the active surface of the gripper element would have to be a distance $$T = p \cdot k/2\pi r$$

from the rotational axis of the cylinder. The radius R is greater than the distance T and, in the example shown, given the values of p and k, T is smaller than the radius r and even smaller than r/2.

In addition to the aforedescribed belt drive, there are numerous possible variations in drives for the gripper elements 15. Thus, for example, fixed gears can be provided which are disposed coaxially to the shaft 10 in the housing 11. A respective gear is fastened coaxially to each of the shafts 14A and 14B and, through a respective intermediate gear, rotatably mounted on the flange 12A and 12B, can mesh with the fixed gears. The belts 18A and 18B are thus replaced by intermediate gears rotatably mounted on the flanges 12A and 12B of the cylinder.

In another embodiment, the gripper elements or rollers 15 are driven rotatably by an internally toothed gear fixed to the frame or housing of the folder coaxially with the axis 10. The shafts 14A and 14B then carry a conventional externally toothed gear which meshes with the internally toothed gear.

Figure 4:
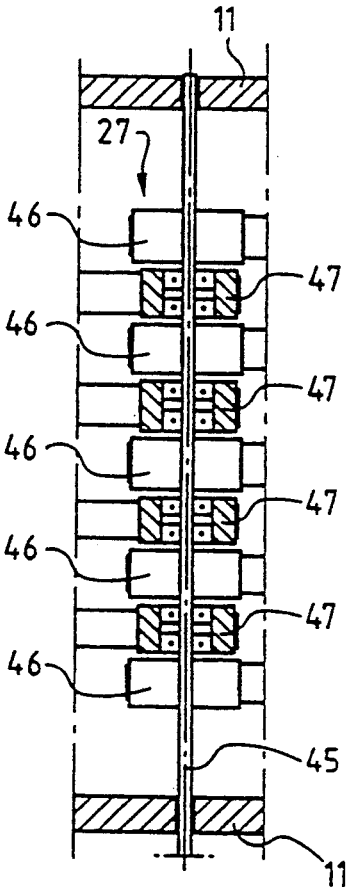
FIG. 4 is a fragmentary cross-sectional view of FIG. 1 taken along the line IV—IV and rotated through 90 degrees, showing a deflecting cylinder assembly common to both the first and the second conveyor belts of the folder.

In FIG. 4, an overlapping belt guide downstream from the first conveyor 7 is illustrated. The cylinder or actually cylinder assembly 27 is formed of a row of mutually adjacent rollers 46 and 47 arranged on a shaft 45. Sub-belts of the upper conveyor belt 26 are passed around the rollers 47 loosely rotating on the shaft 45. The rollers 47 drive the sub-belts of the upper conveyor belt 25 of the first conveyor 7. The shaft 45 is rotatably mounted in the frame or housing 11 of the folder.

The drives respectively associated with FIGS. 2 and 4 are illustrated in FIGS. 5 and 6. Outside the housing or frame 11 of the folder are several driving lines or strings with which a synchronous drive is effected for both conveyors 7 and 8. The cylinders 23, 28, 27 and 22 required for driving the belts in the two conveyors 7 and 8, are driven, in turn, slip-free via gears 30, 31, 32 and 33. A pulley 35 is mounted on the shaft of the gear 30 and cooperates, via a belt 36, with the pulley 34 which is securely mounted on the shaft of the folding jaw cylinder 4. A driving line or string to the shaft 10 of the decelerating device 9 extends via a pulley 37, a belt 39 and a pulley 38 from the shaft on which the gear 31 is mounted. The decelerating device 9 is thereby likewise tied into the synchronous drive of the folder. A belt drive formed of two pulleys 40 and 41 and a belt 42 completes the drive configuration of the individual shafts.

To illustrate the geometrical situation, reference should be made to FIG. 5 from which especially the orientation of the individual rotational axes with respect to one another becomes apparent.

The kinematic system of the folder includes a pulley 34 fixed to the folding roller 4, a pulley 35 fixed to the drive roller 22, the pulleys 34 and 35 being joined by a belt 36; a pulley 37 fixed to the drive roller 27, a pulley 38 fixed to the shaft 10 of the decelerating device or cylinder 9, the pulleys 37 and 38 being joined by a belt 39; and a second pulley 40 fixed to the shaft 10, a pulley 41 fixed to the drive roller 28, the pulleys 40 and 41 being joined by a belt 42. In this manner, the drive rollers of the first and second conveyors are connected one to the other so as to maintain the ratio between the speeds v and V, at the printing machine at the exit end of which the folder is disposed, so that the speeds V and v correspond to the stream of signatures fed to the conveyors 7 and 8, and at the decelerating device 9, so that it operates at the appropriate time.

I claim:

1. Folder for a printing machine comprising a first conveyor for conveying signatures at a given speed, a second conveyor for conveying signatures at a lower speed than said given speed, said second conveyor being located at a downstream end of said first conveyor in a conveying direction of said first conveyor for receiving the signatures directly from said first conveyor, and decelerating means comprising a hollow cylinder and at least one gripper element engageable with the signatures received on said second conveyor for braking the given speed of the received signatures to said lower speed, said at least one gripper element being mounted on at least one additional shaft disposed in said lower cylinder and having a tangential speed corresponding to said lower speed.

2. Folder according to claim 1, including means for disposing the signatures in succession on said first conveyor at a spaced distance between respective leading edges thereof which is greater than the length of one of the signatures, and means for disposing the signatures received on the second conveyor in an overlapping or shingle stream.

3. Folder according to claim 1, wherein said decelerating means have a main shaft and a hollow cylinder having cylindrical end faces carried by said main shaft.

4. Folder according to claim 3, wherein said gripper element is fixed in said decelerating means.

5. Folder according to claim 3, wherein said gripper element is round and is rotatably mounted in said decelerating means.

6. Folder for a printing machine comprising a first conveyor for conveying signatures at a given speed, a second conveyor for conveying signatures at a lower speed than said given speed, said second conveyor being located at a downstream end of said first conveyor in a conveying direction of said first conveyor for receiving the signatures directly from said first conveyor, and decelerating means comprising at least one gripper element engageable with the signatures received on said second conveyor for breaking the given speed of the received signatures to said lower speed, said decelerating means having a main shaft and a hollow cylinder having cylindrical end faces carried by said main shaft, said at least one gripper element being mounted on at least one additional shaft disposed in said hollow cylinder and having a tangential speed corresponding to said lower speed, said gripper element being fixed in said decelerating means, said gripper element being rotatable in a direction opposite to a direction of rotation of said decelerating means.

7. Folder for a printing machine comprising a first conveyor for conveying signatures at a given speed, a second conveyor for conveying signatures at a lower speed than said given speed, said second conveyor being located at a downstream end of said first conveyor in a conveying direction of said first conveyor for receiving the signatures directly from said first conveyor, and decelerating means comprising at least one gripper element engageable with the signatures received on said second conveyor for breaking the given speed of the received signatures to said lower speed, said decelerating means having a main shaft and a hollow cylinder having cylindrical end faces carried by said main shaft, said at least one gripper element being mounted on at least one additional shaft disposed in said hollow cylinder and having a tangential speed corresponding to said lower speed, the folder having opposite frame walls wherein said main shaft is journaled, respective pulleys fastened to said frame walls at respective ends of said main shaft, at least another gripper element mounted on at least another additional shaft in said hollow cylinder, a respective pulley mounted at one of the ends of said additional shafts, and respective belts disposed and rotatable on respective pairs of one of said pulleys fastened to said frame walls and one of the pulleys mounted at one of the ends of said additional shafts.

8. Folder for a printing machine comprising a first conveyor for conveying signatures at a given speed, and a second conveyor for conveying signatures at a lower speed than said given speed, said second conveyor being located at a downstream end of said first conveyor in a conveying direction of said first conveyor for receiving the signatures directly from said first conveyor, and decelerating means comprising at least one gripper element engageable with the signatures received on said second conveyor for braking the given speed of the received signatures to said lower speed, said first and said second conveyors, respectively, comprising a lower endless belt for receiving thereon a respective succession of the signatures to be conveyed, respective driven cylinders cooperatively coupled with said lower endless belts, respectively, for maintaining a ratio between the lower speed and the given speed so that said decelerating means grip a respective signature at an appropriate moment, said driven cylinders being coupled, via different transmissions, with a drive of the printing press for matching the speeds at which the respective successions of signatures are conveyed.

9. Folder for a printing machine comprising a first conveyor for conveying signatures at a given speed, and a second conveyor for conveying signatures at a lower speed than said given speed, said second conveyor being located at a downstream end of said first conveyor in a conveying direction of said first conveyor for receiving the signatures directly from said first conveyor, and decelerating means comprising at least one gripper element engageable with the signatures received on said second conveyor for braking the given speed of the received signatures to said lower speed, said first and said second conveyors, respectively, comprising a lower endless belt for receiving thereon a respective succession of the signatures to be conveyed, respective driven cylinders cooperatively coupled with said lower endless belts, respectively, for maintaining a ratio between the lower speed and the given speed so that said decelerating means grip a respective signatures at an appropriate moment, said driven cylinders being coupled, via different transmissions, with a drive of the printing press for matching the speeds at which the respective successions of signatures are conveyed, and including adjusting means for controlling the height at which the rotational axis of a cylinder cooperatively coupled with the lower endless belt of said second conveyor is disposed and for enabling adjustment of the gripper action of said decelerating means.

10. Folder according to claim 9, wherein said lower and upper belts of said first conveyor are rotatingly mounted around driven cylinders having respective axes of rotation disposed in a transversely inclined plane.

11. Folder for a printing machine comprising a first conveyor for conveying signatures at a given speed, and a second conveyor for conveying signatures at a lower speed than said given speed, said second conveyor being located at a downstream end of said first conveyor in a conveying direction of said first conveyor for receiving the signatures directly from said first conveyor, and decelerating means comprising at least one gripper element engageable with the signatures received on said second conveyor for braking the given speed of the received signatures to said lower speed, said first and said second conveyors, respectively, comprising a lower endless belt for receiving thereon a respective succession of the signatures to be conveyed, respective driven cylinders cooperatively coupled with said lower endless belts, respectively, for maintaining a ratio between the lower speed and the given speed so that said decelerating means grip a respective signature at an appropriate moment, said driven cylinders being coupled, via different transmissions, with a drive of the printing press for matching the speeds at which the respective successions of signatures are conveyed, said first and said second conveyors, respectively, including an upper endless belt similar to said lower belt for ensuring successive disposition of the signatures, said driven cylinders of said first conveyor being mutually cooperative so that said upper endless belt and said lower endless belt of said first conveyor travel at said given speed, and said driven cylinders of said second conveyor being mutually cooperative so that said upper endless belt and said lower endless belt of said second conveyor travel at said lower speed.

12. Folder according to claim 10, wherein an upstream end of said upper belt of said second conveyor intersects with a downstream end of said upper belt of said first conveyor for guiding the signatures received by said second conveyor from said first conveyor at a transition location therebetween.

13. Folder according to claim 12, wherein said upper endless belts, respectively, are each formed of a row cf endless sub-belts, and including, at said downstream end of said upper belt of said first conveyor, a shaft carrying a plurality of rollers, respective rollers of mutually adjacent pairs thereof being rotatable independently of one another and cooperating respectively with a respective sub-belt of said upper endless belt of said first conveyor and a respective sub-belt of said upper endless belt of said second conveyor.

14. Folder according to claim 13, wherein said decelerating means comprise a rotatable hollow cylinder carrying said at least one gripper element, and said sub-belts of said upper endless belt of said second conveyor connect an exit of said first conveyor with an upstream entrance to said lower belt of said second conveyor, said last-mentioned sub-belts being rotatably mounted on and between an outer cylindrical surface of said hollow cylinder and respective rollers carried by said shaft at said downstream end of said upper belt of said first conveyor.

* * * * *

UNITED STATES PATENT AND TRADEMARK OFFICE

CERTIFICATE OF CORRECTION

PATENT NO. : 5,102,111

DATED : April 7, 1992

INVENTOR(S) : Andre' Reponty

It is certified that error appears in the above-identified patent and that said Letters Patent is hereby corrected as shown below:

On the Title page, item [75] change

"Andrû Reponty"

to

-- Andrê Reponty --.

Signed and Sealed this

Twentieth Day of July, 1993

*Attest:*

Michael K. Kirk

MICHAEL K. KIRK

*Attesting Officer*

*Acting Commissioner of Patents and Trademarks*